US007987520B2

(12) United States Patent
Henriquez

(10) Patent No.: US 7,987,520 B2
(45) Date of Patent: Aug. 2, 2011

(54) CONCEALABLE SHOULDER-SUPPORTED HARNESS SYSTEM FOR A BELT AND A CLOTHING ATTIRE UTILIZING THE SAME

(76) Inventor: Erik Henriquez, Woodhaven, NY (US)

( * ) Notice: Subject to any disclaimer, the term of this patent is extended or adjusted under 35 U.S.C. 154(b) by 869 days.

(21) Appl. No.: 11/895,479

(22) Filed: Aug. 24, 2007

(65) Prior Publication Data

US 2011/0093996 A1 Apr. 28, 2011

(51) Int. Cl.
*A41D 13/00* (2006.01)

(52) U.S. Cl. ..... 2/69

(58) Field of Classification Search ..... 2/69, 94, 2/69.5, 102, 44–45, 327, 108, 300, 311–319; 182/3–6; 244/151 R
See application file for complete search history.

(56) References Cited

U.S. PATENT DOCUMENTS 5,319,806 A * 6/1994 Hermann et al. ..... 2/461
6,658,666 B2 * 12/2003 Schweer ..... 2/94
7,036,628 B2 * 5/2006 Wilcox et al. ..... 182/9
7,451,495 B2 * 11/2008 Munn et al. ..... 2/94

* cited by examiner

*Primary Examiner* — Tejash Patel
(74) *Attorney, Agent, or Firm* — Watov & Kipnes, P.C

(57) ABSTRACT

A concealable shoulder-supported harness system for a belt fastened around the torso of a wearer, includes a support portion adapted for operative engagement with the upper torso of the wearer above the belt, wherein the support portion is further adapted for concealment within an outer garment having a portion of the garment extending substantially through the interior side of the belt, and a fastening portion extending from a lower end of the support portion through an aperture in the outer garment located proximate to the belt, wherein the fastening portion further includes an attachment mechanism for securing attachment to the belt. The present invention is further directed to a clothing attire utilizing the same.

17 Claims, 4 Drawing Sheets

CONCEALABLE SHOULDER-SUPPORTED HARNESS SYSTEM FOR A BELT AND A CLOTHING ATTIRE UTILIZING THE SAME

FIELD OF THE INVENTION

The present invention relates to harness systems, and more particularly, a concealable shoulder-supported harness system for a belt typically for use by those charged with law enforcement.

BACKGROUND OF THE INVENTION

A law enforcement or police duty belt, also referred to as a gun belt, is a belt designed for individuals who need to effectively carry equipment with them during assignments. The most notable examples of such individuals include police officers, military personnel, security guards, and the like. The police duty belt is strapped around the wearer's torso such as, for example, the waist, and fastened with a buckle at the front. The police duty belt can be configured to carry, for example, handcuffs, radios, notebooks or pads, handheld weapons such as pepper spray, electroshock guns, firearms, and ammunition. The police duty belt allows the wearer to effectively meet the tactical needs necessary to accomplish a task in the line of duty.

Most police duty belts are about 2 inches wide and are made of either nylon or leather. The police duty belts are generally constructed with a double ply material for retaining shape and withstanding the weight of the equipment on the belt. The police duty belts typically carry more than 20 lbs. of equipment. On a daily basis, police officers are expected to endure tremendous physical demands including, but not limited to, continuously sitting while driving a patrol vehicle and/or writing reports, standing on uneven or wet surfaces, walking or running in and out doors on uneven or hilly terrain, lifting items weighing over 100 lbs., including human bodies, frequent bending, stooping, pulling, pushing, climbing, running, and driving.

Under such physical demands, the police duty belt can impose on the wearer an arduous physical burden that can hinder, or even endanger, the wearer. Frequently, the police duty belt can undesirably shift, slide or slip during physical exertion, cause chaffing or discomfort which requires constant adjusting or lifting, and generate is pressure stress on the stomach, hips and lower back. These problems can adversely hamper the performance and safety of the wearer in the course of patrolling and carrying out police duties.

Accordingly, there is a need for a concealable shoulder-supported harness system for a belt, which is designed to alleviate problems typically associated with such use, while ensuring the safety and comfort of the wearer. There is a further need for a concealable shoulder-supported harness system for a belt, which is designed to operate inconspicuously and maximize the wearer's freedom of movement and ease of travel.

SUMMARY OF THE INVENTION

The present invention is related to a concealable shoulder-supported harness system for a belt including utility belts such as a police duty belt. The belt is strapped around the wearer's torso such as the waist area. The harness system of the present invention is designed to operatively engage the belt, and transfer the weight of the belt from the waist area to the upper torso area, specifically the shoulder areas. In this manner, this design greatly alleviates the undesirable pressure and chaffing on the stomach, hip and back areas that would otherwise cause discomfort and limit the user's range of movement, and effectively eliminates the need to constantly re-adjust and lift the belt due to shifting, sliding or slippage. The harness system of the present invention is constructed for concealment beneath outer garments, which maximizes the wearer's freedom of movement and ease of travel.

The harness system of the present invention comprises a support portion which operatively engages the upper torso of the wearer above the belt, wherein the support portion is further adapted for concealment within an outer garment having a lower end tucked in along the interior side of the belt, and a fastening portion which extends from a lower end of the support portion through an aperture in the outer garment located proximate to the belt, wherein the fastening portion further includes an attachment mechanism for securing attachment to the belt.

The harness system of the present invention is used in combination with a belt, which refers broadly to a flexible band worn around the torso of a body, such as the waist. In a preferred embodiment, the harness system of the present invention is used in combination with a utility or service belt, which is a form of a belt adapted specifically for carrying items. Users of such utility belts include police officers, law enforcement personnel, military personnel, security guards, repair personnel, rescue personnel, first responders, medics, recreational sportsmen, and the like. Examples of utility belts include, but are not limited to, police duty belts, tool belts, gun belts, medic supply belts, ammunition supply belts, rescue belts, and the like.

In one aspect of the present invention, there is provided a concealable shoulder-supported harness system for a belt fastened around the torso of a wearer, comprising:

a support portion adapted for operative engagement with the upper torso of the wearer above the belt, the support portion further adapted for concealment within an outer garment having a portion of the garment extending substantially through the interior side of the belt; and a fastening portion extending from a lower end of the support portion through an aperture in the outer garment located proximate to the belt, the fastening portion further including an attachment mechanism for securing attachment to the belt.

In another aspect of the present invention, there is provided a clothing attire having a concealable shoulder-supported harness system for a belt fastened around the torso of a wearer, comprising:

an outer garment having an aperture locate proximate to the belt during wear, and a portion of the garment extending substantially through the interior side of the belt;

a support portion adapted for operative engagement with the upper torso of a wearer above the belt, the support portion further adapted for concealment within the outer garment; and a fastening portion extending from a lower end of the support portion through the aperture of the outer garment, the fastening portion further including an attachment mechanism for securing attachment to the belt.

BRIEF DESCRIPTION OF THE DRAWINGS

The following drawings are illustrative of embodiments of the present invention and are not intended to limit the invention as encompassed by the claims forming part of the application.

DETAILED DESCRIPTION OF THE INVENTION

The present invention is directed to a concealable shoulder-supported harness system for a belt including utility belts such as a police belt. The belt is strapped around the wearer's torso such as the waist area. The harness system of the present invention is designed to operatively engage the belt, and transfer and more evenly distribute the weight of the belt from the waist area to the upper torso area, specifically the shoulder areas. In this manner, this design greatly alleviates the undesirable pressure and chaffing on the stomach, hip and back areas that would otherwise cause discomfort and limit the user's range of movement, and effectively eliminates the need to constantly re-adjust and lift the belt due to shifting, sliding or slippage. The harness system of the present invention is constructed for concealment beneath outer garments, which maximizes the wearer's freedom of movement and ease of travel.

There is provided a concealable shoulder-supported harness system for a belt fastened around the torso of a wearer, which comprises a support portion adapted for operative engagement with the upper torso of the wearer above the belt, wherein the support portion is further adapted for concealment within an outer garment having a portion of the garment extending substantially through the interior side of the belt, and a fastening portion extending from a lower end of the support portion through an aperture in the outer garment located proximate to the belt, wherein the fastening portion further includes an attachment mechanism for securing attachment to the belt.

The term "torso" refers generally to a trunk portion of the human body excluding the head and limbs.

The term "outer garment" refers generally to any form of clothing or layers of clothing covering at least a portion of the torso of the wearer in which at least a portion of the clothing extends substantially through the interior side of a belt. Examples of outer garments include shirts, undershirts, overalls, pullovers, T-shirts, sweatshirts, sweaters, jackets, coats, and the like.

The harness system of the present invention is used in combination with a belt, which refers broadly to a flexible band worn around the torso of a body, such as the waist. In a preferred embodiment, the harness system of the present invention is used in combination with a utility or service belt, which is a form of a belt adapted specifically for carrying items. Users of such utility belts include police officers, law enforcement personnel, military personnel, security guards, repair personnel, rescue personnel, first responders, medics, recreational sportsmen, and the like. Examples of utility belts include, but are not limited to, police duty belts, tool belts, gun belts, medic supply belts, ammunition supply belts, rescue belts, and the like.

Figure 1:
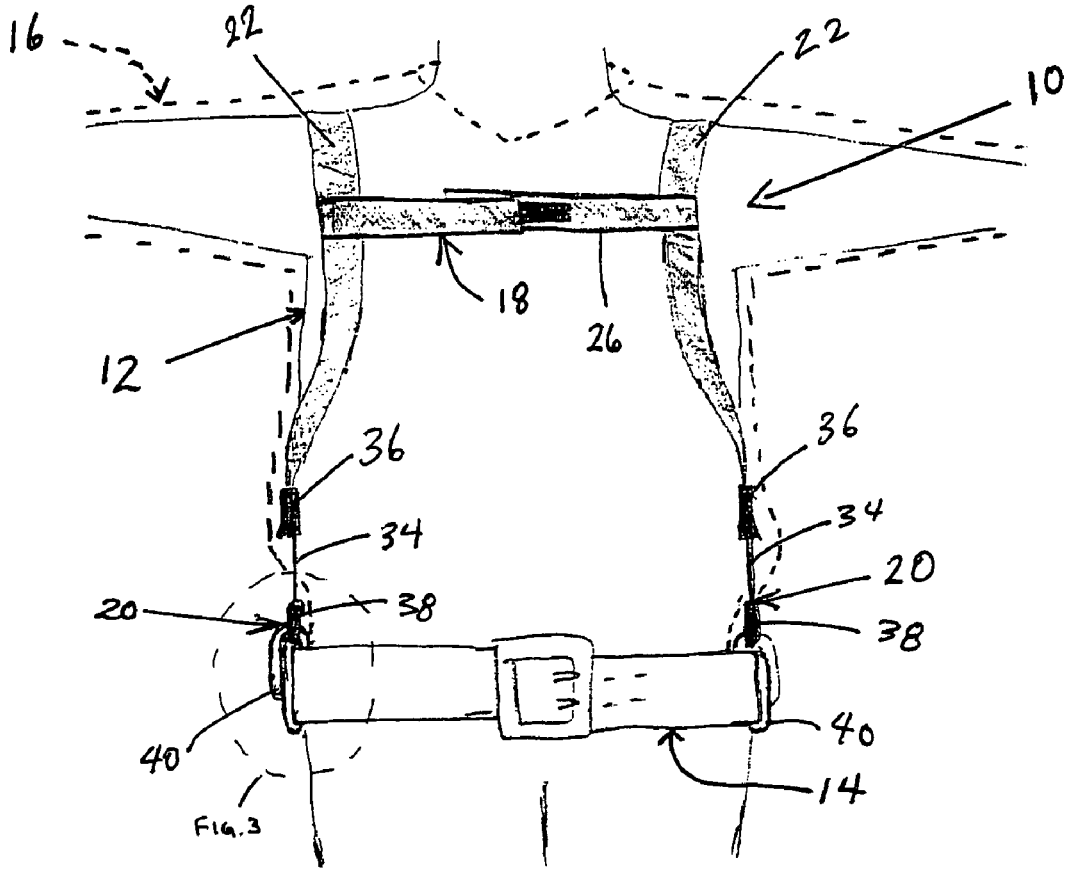
FIG. 1 is a front elevational view of a concealable shoulder-supported harness system as worn by a wearer for one embodiment of the present invention.

Referring to FIG. 1, a concealable shoulder-supported harness system, or "harness system" hereinafter, identified generally by reference numeral 10 is shown for one embodiment of the present invention. The harness system 10 is designed to transfer and more evenly distribute the weight of the belt over the upper torso areas including the shoulders. The harness system 10 will be described in context with the use of a police duty belt of the type a police officer or law enforcement agent would encounter. However, it will be understood that the harness system of the present invention is not limited to use with such type of belts, and can flexibly be used in connection with other types as described above.

As shown in FIG. 1, the harness system 10 is worn on the torso of a wearer 12 above a police duty belt 14. The police duty belt 14 is strapped around the wearer's torso, and more specifically around the waist area. The harness system 10 includes a support portion 18 adapted for fastening to the torso of the wearer 12, and constructed to remain hidden beneath an outer garment 16. The lower end of the outer garment 16 is tucked in under the belt 14. In the context of law enforcement use, the concealed feature of the present invention prevents an adversary or perpetrator from gaining leverage against the wearer 12 in the event of a struggle, thereby increasing safety and reducing risk of injury to the wearer 12.

The harness system 10 includes a fastening portion 20, which extends from the lower end of the support portion 18. The fastening portion 20 projects through an aperture (not shown) in the outer garment 16, where it securely engages the police duty belt 14 as will be described in greater detail hereinafter. The support portion 18 and the fastening portion 20 may be constructed from any flexible, high tensile material such as, for example, a polymer material in the form selected from woven, nonwoven, knit and combinations thereof. Preferably, the polymer material is a nylon web material.

Figure 2:
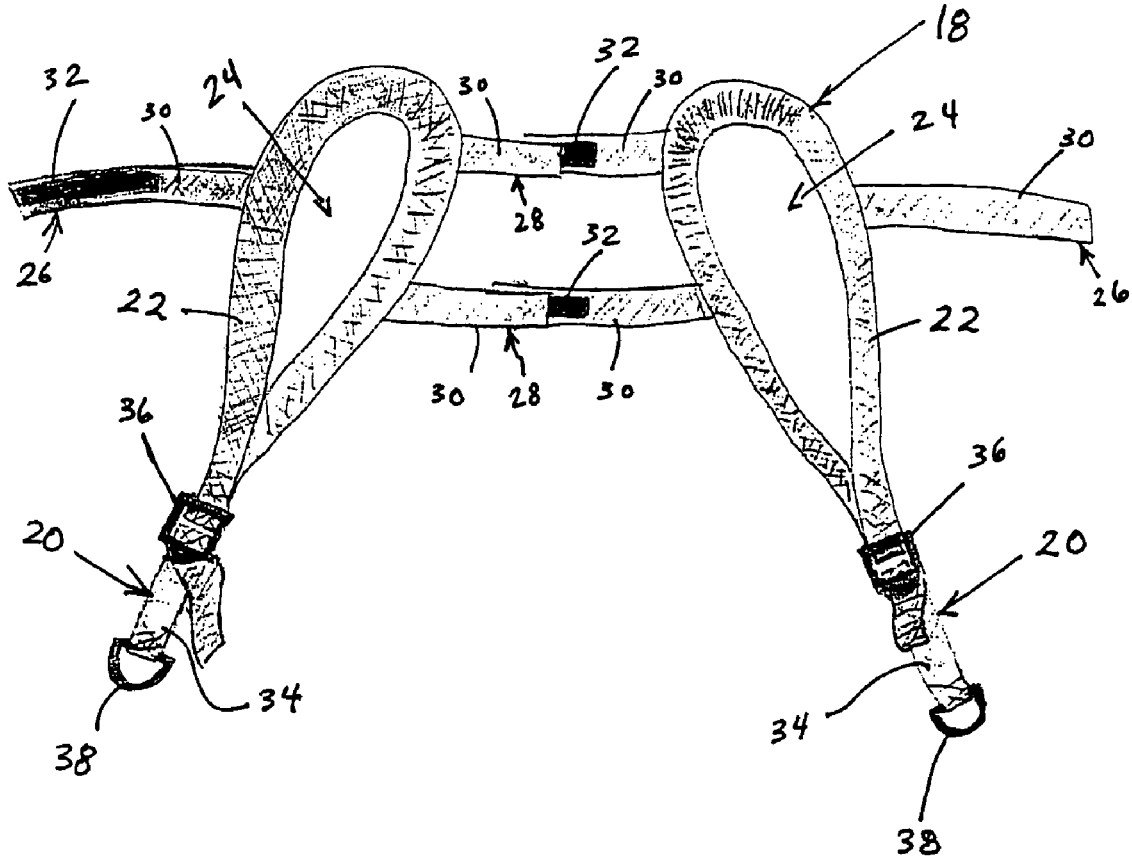
FIG. 2 is a rear elevational view of the harness system of FIG. 1 in accordance with the present invention.

Referring to FIG. 2, the support portion 18 includes a pair of opposing looped straps 22 each defining an opening 24 for receiving a wearer's arm therethrough (as shown best in FIG. 1). The opposing looped straps 22 are retained together by a combination comprising a front adjustable strap 26 and a pair of rear adjustable straps 28. Each of the adjustable straps 26 and 28 includes a pair of corresponding straplets 30, which are securely fastened to one another by a releasable fastener 32. The adjustable straps 26 and 28 prevent the looped straps 22 from slipping off the shoulder of the wearer 12. The releasable fastener 32 may be in the form of a hook and loop fastener such as VELCRO™. The adjustable straps 26 and 28 allow the user to adjust the fit and comfort of the support portion 18 around the wearer's torso via the releasable fasteners 32. It will be understood that the configuration and form of the support portion is. 18 of the harness system 10 is not limited to the embodiment shown herein, and may be modified or substituted with any suitable configuration as known to one skilled in the art.

The fastening portion 20 includes a pair of support straps 34 each extending from a corresponding looped strap 22, a pair of strap adjusters 36 for adjusting the length of the support strap 34, and a pair of D-rings 38 attached at the end of the corresponding support straps 34. As shown in FIG. 1, the support straps 34 extend at the sides of the wearer 12 through apertures (not shown) in the outer garment 16. The D-rings 38 provide connection points for belt keepers 40 strapped to the police duty belt 14. In the present embodiment, the strap adjuster 36 is in the form of a strap buckle, which allows the wearer 12 to adjust the length of the corresponding support strap 34 to set the desired height of the police duty belt 14.

Figure 3:
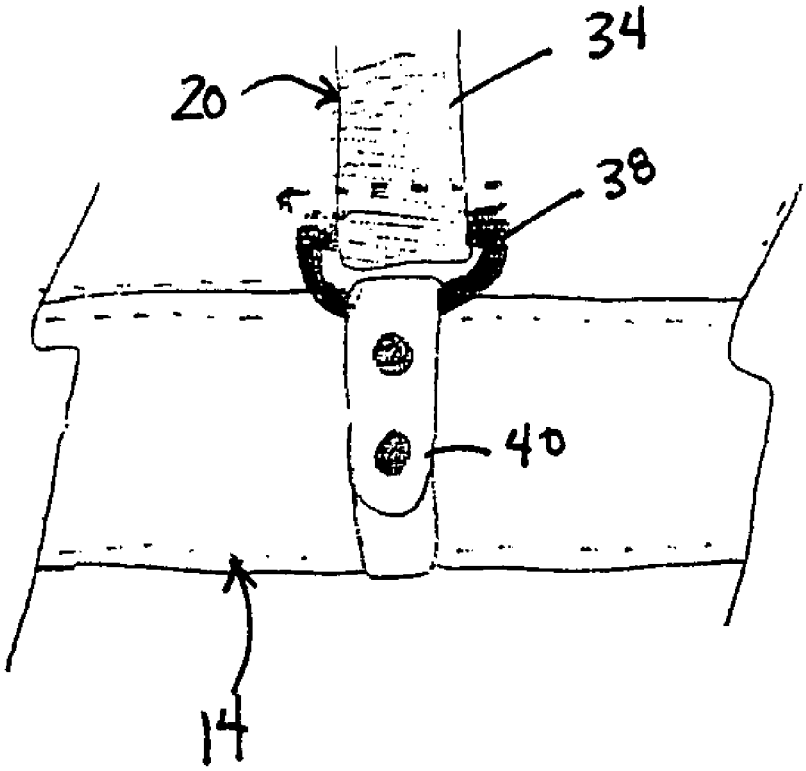
FIG. 3 is a more detailed side view of a fastening portion of the harness system identified by the circled area marked "FIG. 3" of FIG. 1 in accordance with the present invention.

Referring to FIG. 3, a more detailed view of the fastening portion 20 is shown in accordance with the present invention. The belt keeper 40 is a clip fastened strap that encircles the police duty belt 14. The belt keeper 40 is strapped into the D-ring 38 and the police duty belt 14 to provide a secure attachment therebetween. Optionally, a three-way buckle (not shown) may be incorporated into the fastening portion 20 between the strap adjuster 36 and the D-ring 38 to provide a quick release fastening mechanism. It will be understood that the form of connection between the fastening portion 20 of the harness system 10 and the police duty belt 14 is not limited to the embodiment shown herein, and may be modified or substituted with any attachment configuration as known to one skilled in the art.

Figure 4:
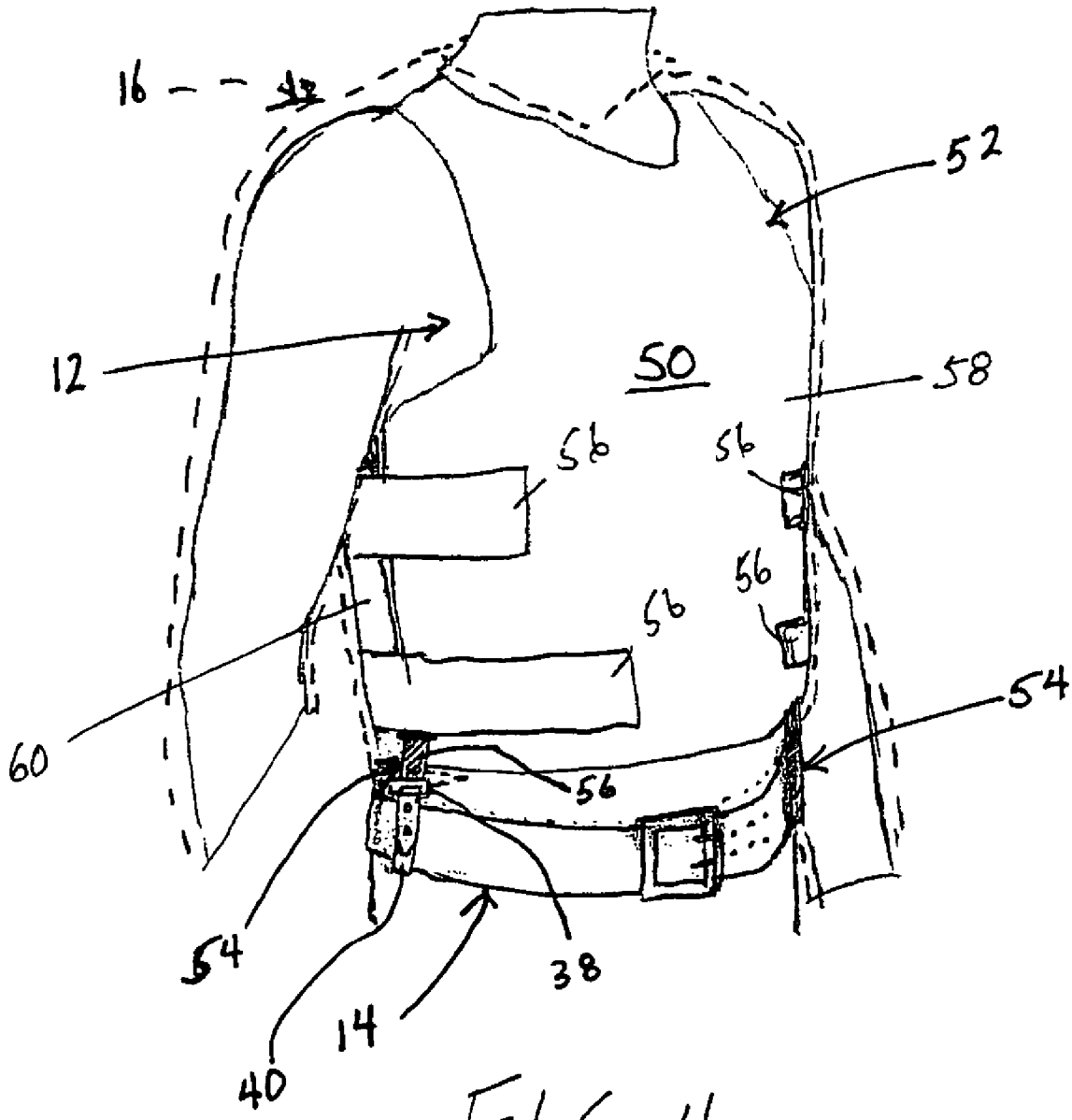
FIG. 4 is a perspective view of a concealable shoulder-supported harness system for a second embodiment of the present invention.

Referring to FIG. 4, a concealable shoulder-supported harness system identified generally by reference numeral 50 is shown for a second embodiment of the present invention. Most of the features of the harness system 50 are similar to the harness system 10 of the previous embodiment. The harness system 50 includes a support portion 52 in the form of body armor, preferably in the form of a ballistic or bulletproof vest, and a fastening portion 54 extending therefrom. The support portion 52 is worn underneath the outer garment 16 for concealed operation.

The support portion 52 includes a front panel 58, and a rear panel 60. The front and rear panels 58 and 60 substantially encompass the upper torso of the wearer 12. The front and rear panels 58 and 60 are held together by four side straps 56 extending from the rear panel 60 affixed to the front panel 58 via a hook and loop fastening means. The fastening portion 54 operates in essentially the same manner as described above. The fastening portion 54 includes a support strap 54 extending from the lower end of the ballistic vest 52, which may be adjusted via the strap adjuster 36 (see FIGS. 1 and 2). The support strap 54 is attached to the police duty belt 14 via the belt keeper 40.

The present invention is further directed to a clothing attire having a concealable shoulder-supported harness system for a belt fastened around the torso of a wearer, which comprises an outer garment having an aperture locate proximate to the belt during wear, and a portion of the garment extending substantially through the interior side of the belt, a support portion adapted for operative engagement with the upper torso of a wearer above the belt, the support portion further adapted for concealment within the outer garment, and a fastening portion extending from a lower end of the support portion through the aperture of the outer garment, the fastening portion further including an attachment mechanism for securing attachment to the belt. The clothing attire may form part of a uniform, for example.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A concealable shoulder-supported harness system for a belt fastened around the waist of a wearer's torso, comprising:

a support portion having a front side, a rear side and opposed lateral sides, said support portion being adapted for operative engagement with the upper torso of the wearer above the belt wherein the support portion comprises a pair of opposing looped straps having a first end and a second end, said looped straps each adapted for receiving an arm of the wearer; and at least two adjustable straps each extending across one of the first and second ends of the looped straps, said adjustable straps configured for adjusting the span between the opposing looped straps so that the opposed lateral sides of the support portion are proximate to the opposed lateral sides of the wearer's torso, said support portion further being adapted for concealment within an outer garment; and a pair of opposed fastening portions each extending from a corresponding lateral side of the support portion, said fastening portions being adapted for projecting through the fabric of the outer garment proximate the belt, said fastening portions further including an attachment mechanism for reversible attachment to the belt wherein the support portion comprises a pair of opposing looped straps having a first end and a second end, said looped straps each adapted for receiving an arm of the wearer; and at least two adjustable straps each extending across one of the first and second ends of the looped straps, said adjustable straps configured for adjusting the span between the opposing looped straps.

2. The harness system of claim 1 wherein the adjustable straps further include fasteners.

3. The harness system of claim 2 wherein the fasteners are hook-and-loop fasteners.

4. The harness system of claim 1 wherein the fastening portions each comprise at least one strap extending from the support portion.

5. The harness system of claim 4 further comprising adjustment means located on the at least one strap for adjusting the length thereof.

6. The harness system of claim 5 wherein the adjustment means is a strap buckle.

7. The harness system of claim 1 wherein the support portion is in the form of a body armor.

8. The harness system of claim 7 wherein the body armor is a ballistic vest.

9. The harness system of claim 1 wherein the attachment mechanism comprises a belt keeper adapted for reversible attachment to the belt.

10. The harness system of claim 1 wherein the support portion and fastening portion comprise a polymer material in a form selected from the group consisting of woven, non-woven, knit and combinations thereof.

11. The harness system of claim 10 wherein the polymer material is a nylon web.

12. The harness system of claim 1 wherein the belt is a utility belt.

13. The harness system of claim 12 wherein the utility belt is selected from the group consisting of police duty belts, tool belts, gun belts, medic supply belts, ammunition supply belts, and rescue belts wherein the support portion comprises a pair of opposing looped straps having a first end and a second end, said looped straps each adapted for receiving an arm of the wearer; and at least two adjustable straps each extending across one of the first and second ends of the looped straps, said adjustable straps configured for adjusting the span between the opposing looped straps.

14. The clothing attire of claim 13 wherein the support portion comprises:

a pair of opposing looped straps having a first end and a second end, said looped straps each adapted for receiving an arm of the wearer; and at least two one adjustable straps each extending across one of the first and second ends of the looped straps, said adjustable straps configured for adjusting the span between the opposing looped straps.

15. The clothing attire of claim 14 wherein the adjustable straps further include fasteners.

16. The clothing attire of claim 14 wherein the fastening portion comprises at least one strap extending from the support portion.

17. The harness system of claim 14 wherein the attachment mechanism comprises a belt keeper adapted for reversible securement to the belt.

* * * * *